US006269498B1

(12) United States Patent
Perkins

(10) Patent No.: US 6,269,498 B1
(45) Date of Patent: Aug. 7, 2001

(54) BED SUPPORT MECHANISM

(76) Inventor: Landon E. Perkins, 215 Red Hill Dr., Martinsville, VA (US) 24112

( * ) Notice: Subject to any disclaimer, the term of this patent is extended or adjusted under 35 U.S.C. 154(b) by 0 days.

(21) Appl. No.: 09/246,510

(22) Filed: Feb. 9, 1999

(51) Int. Cl.[7] ..... A47C 19/00
(52) U.S. Cl. ..... 5/181; 5/184; 5/202
(58) Field of Search ..... 5/658, 181, 176.1, 5/200.1, 201, 202

(56) References Cited

U.S. PATENT DOCUMENTS

| | | | | |
|---|---|---|---|---|
| 2,886,832 | | 5/1959 | Mitchell et al. | 5/236 |
| 3,123,837 | * | 3/1964 | Paine et al. | 5/181 |
| 3,744,068 | * | 7/1973 | Harris | 5/181 |
| 3,757,361 | | 9/1973 | Harris et al. | 5/184 |
| 3,824,638 | * | 7/1974 | Bogar | 5/181 |
| 3,984,884 | | 10/1976 | Spitz | 5/176 |
| 4,019,211 | | 4/1977 | Spitz | 5/181 |
| 4,106,141 | | 8/1978 | Hooker | 5/201 |
| 4,135,266 | | 1/1979 | Knoke | 5/201 |
| 4,218,789 | | 8/1980 | Grassi | 5/201 |
| 4,224,704 | | 9/1980 | Nowell | 5/181 |
| 4,263,683 | | 4/1981 | Knoke | 5/200 |
| 4,276,665 | | 7/1981 | Mis | 5/184 |
| 4,536,904 | | 8/1985 | Whitehead | 5/201 |
| 5,243,720 | | 9/1993 | Harrow | 5/201 |
| 5,815,860 | | 10/1998 | Mitchell | 5/236.1 |

* cited by examiner

*Primary Examiner*—Lynne H. Browne
*Assistant Examiner*—Fredrick Conley
(74) *Attorney, Agent, or Firm*—Rhodes & Mason, P.L.L.C.

(57) ABSTRACT

A bed support mechanism. The mechanism includes at least two substantially identical L-shaped support members each including a top section and a leg section, the top sections being adjacently positioned to one another and each of the leg sections extending downward at opposite ends of the adjacently positioned L-shaped support members to support the bed. In the preferred embodiment, an adjustable foot is connected to the distal end of each of the leg sections to provide adjustment for beds of different heights. Also, in the preferred embodiment, the L-shaped support members are connected together by bolts and wing nuts which extend through a plurality of apertures spaced along the length of the top section wherein the apertures align at pre-selected positions along the length of the L-shaped support members for inserting the fasteners. In the preferred embodiment, the position of the apertures is the same for each of the pair of the L-shaped support members thereby allowing a single design to serve for each of the pair.

42 Claims, 6 Drawing Sheets

A
B
C
D
L
12
14
150
152
154
156
158
160
162
164
166
168

BED SUPPORT MECHANISM

BACKGROUND OF THE INVENTION

1. Field of the Invention

The present invention relates generally to bed support mechanisms and, more particularly, to a bed support mechanism having at least two substantially identical members that are adjustably connected for supporting a variety of bed widths.

2. Description of the Prior Art

Bed frames provide a pleasing appearance while supporting the mattress and/or bedspring resulting in longer life for the bed and a more comfortable feel for the user. The traditional western bed design includes a frame having two side rails running between a headboard and a footboard that support the mattress and bedspring along its edges. Slats extend between the side rails providing support for the bed interior, which is particularly necessary as a majority of the weight placed upon the bed, is in the middle, away from the edges. However, previously available bed support mechanisms have a number of disadvantages.

There are currently numerous different bed width designs available on the market. For example, common bed widths include a double having about a fifty-four inch width, a queen having about a sixty-inch width, a California king having about a seventy-six inch width, and a king having about a seventy-eight inch width. Therefore, a manufacturer who makes these four separate bed designs is required to manufacture and stock four separate sizes of bed supports. Additionally, there may be manufacturing variances in the widths which require the support mechanisms to be adjustable. For example, a sixty inch bed may have manufacturing variances resulting in the width actually extending between about fifty-nine to sixty-one inches.

Another drawback of previous support mechanisms is placing an interior foot or feet that extend from the bed slats to the floor to help support the bed. Many previous designs require the user to place the interior feet at the proper position along the length of the support length to support the interior of the bed. If the placement is incorrect, such as too far or too close to the side rails, there is little support which may result in the bed slat failing. Additionally, many previous designs utilized pivotable interior feet. The drawback of this design is that if the bed were to slide laterally, the interior feet may pivot upward so as not to support the interior of the bed.

Thus, there remains a need for a new and improved bed support mechanism which provides support for beds of various widths while, at the same time, includes adjustable height interior feet to provide support to the interior of the bed.

SUMMARY OF THE INVENTION

The present invention is directed to a bed support mechanism. The mechanism includes: at least two substantially identical L-shaped support members each including a top section and a leg section, the top sections being adjacently positioned to one another and each of the leg sections extending downward at opposite ends of the adjacently positioned L-shaped support members to support the bed. In the preferred embodiment; an adjustable foot is connected to the distal end of each of the leg sections to provide adjustment for beds of different heights.

The L-shaped support members may be selectively positioned to provide support for a bed having a width in the range of between about 54 inches to about 78 inches. Specifically, the length of the top section of each of the L-shaped support members is greater than about one half the width of the widest accommodated bed width while, at the same time, the length of the top section of each of the L-shaped support members is less than the width of the smallest bed size.

In the preferred embodiment, the L-shaped support members are connected together by bolts and wing nuts which extend through a plurality of apertures spaced along the length of the top section wherein the apertures align at pre-selected positions along the length of the L-shaped support members for inserting the fasteners. In the preferred embodiment, the position of the apertures is the same for each of the pair of the L-shaped support members thereby allowing a single design to serve for each of the pair. In an alternative embodiment, the L-shaped support members are connected together by one or more conventional C-clamps or U-shaped brackets which, may provide sufficient strength for many applications.

Accordingly, one aspect of the present invention is to provide a bed support mechanism including at least two substantially identical L-shaped support members each including a top section and a leg section, the top sections being adjacently positioned to one another and each of the leg sections extending downward at opposite ends of the adjacently positioned L-shaped support members to support the bed.

Another aspect of the present invention is to provide a bed support mechanism. The mechanism includes: at least two substantially identical L-shaped support members each including a top section and a leg section, the top sections being adjacently positioned to one another and each of the leg sections extending downward at opposite ends of the adjacently positioned L-shaped support members to support the bed; and an adjustable foot connected to the distal end of each of the leg section and extending to the floor to provide adjustment for beds of different heights.

Still another aspect of the present invention is to provide a bed support mechanism. The mechanism includes: at least two substantially identical L-shaped support members each including a top section and a leg section, the top sections being adjacently positioned to one another and each of the leg sections extending downward at opposite ends of the adjacently positioned L-shaped support members to support the bed; an adjustable foot connected to the distal end of each of the leg sections to provide adjustment for beds of different heights; and means for selectively positioning the L-shaped support members to provide support for a bed having a width in the range of between about 54 inches to about 78 inches.

These and other aspects of the present invention will become apparent to those skilled in the art after a reading of the following description of the preferred embodiment when considered with the drawings.

DESCRIPTION OF THE PREFERRED EMBODIMENTS

Figure 1:
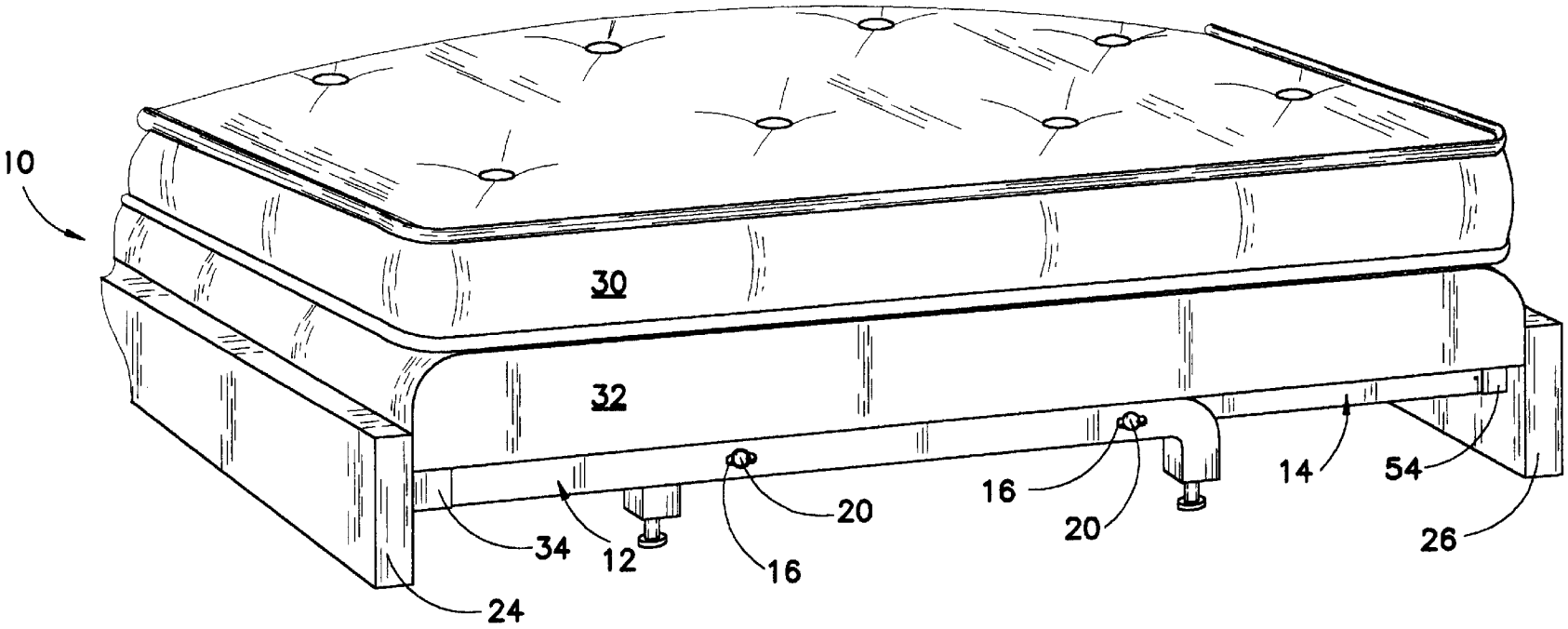
FIG. 1 is a perspective view of a bed support mechanism, constructed according to the present invention, in use under a bed.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a bed support mechanism, generally designated 10, is shown constructed according to the present invention. The bed support mechanism includes at least one pair of substantially identical L-shaped support members 12, 14. The support members include apertures 16 which extend through the L-shaped support members to allow for fasteners 20 to extend therethrough and connect the pair of L-shaped support members together. The support members extend between side rails 24, 26 to support the mattress 30 and/or bed spring 32. Cleats 34 may be mounted on the insides of the side rails 24, 26 for attachment by the support members 12, 14.

Figure 2:
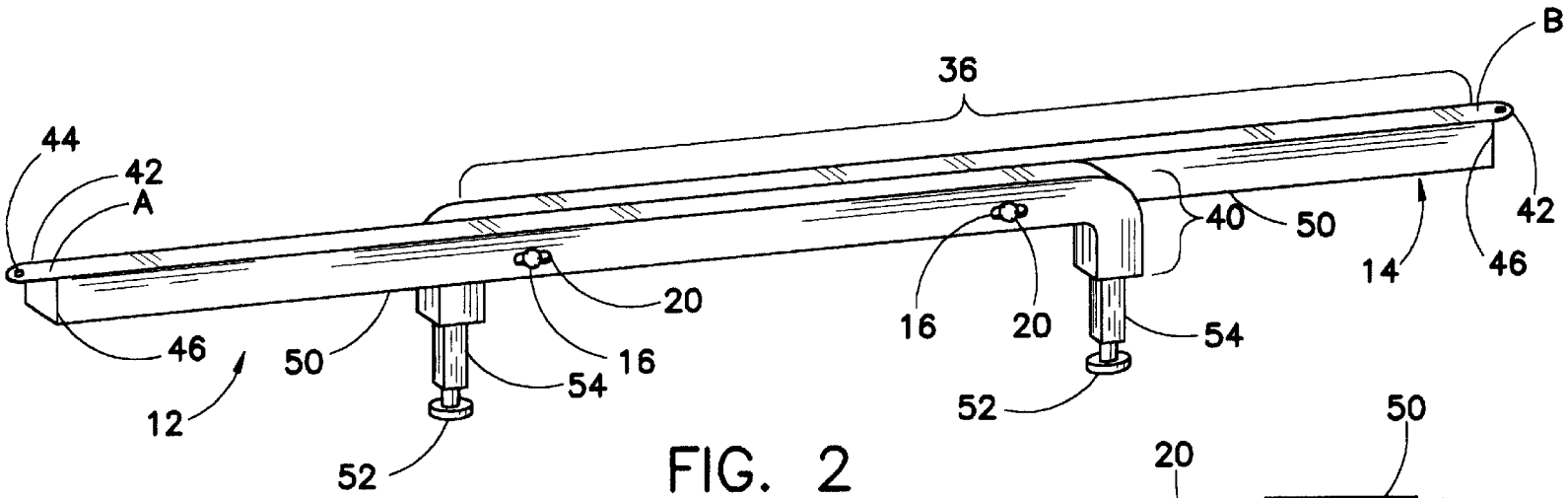
FIG. 2 is a perspective view of the bed support mechanism removed from the bed.

Turning now to FIG. 2, there is illustrated a single pair of connected L-shaped support members 12, 14. Each of the support members is substantially identical providing for ease in manufacturing as only a single design is required. This design is also preferable for retailers as the design is adjustable to accommodate a variety of bed widths. Each support member includes a top section 36 and a leg section 40. Preferably, the leg section 40 extends at about a 90° angle to the top section, as illustrated in FIG. 2. It will be understood by one skilled in the art that the leg section 40 may extend at any angle relative to the top section depending on the particular application.

When the adjacent L-shaped support members are fastened together, the top sections 36 align to support the bed spring 32 and/or mattress 30 having a combined length extending from Point A to Point B as illustrated in FIG. 2. A mount 42 is included on each end of the L-shaped support members to connect to the side rail 24, 26 and cleat 34. The mount 42 extends beyond the lower edge 46 of the top section for placing over the cleat 34. An aperture 44 may further be included on the mount for connecting to the cleat via screw, nail or other like fastener. The mount 42 may alternatively be constructed of an L-shaped member which abuts both the cleat 34 and side rails 24 or 26.

Another embodiment features L-shaped brackets attached to the top side of each of the L-shaped members 12, 14 for attaching to the bed rails. This embodiment is described in U.S. patent application Ser. No. 09/034,058 filed Mar. 3, 1998, herein incorporated by reference in its entirety.

The sides of the top section 36 include apertures 16 spaced along the length for attaching the adjacent L-shaped support members. The apertures 16 extend through the entire width of each of the L-shaped members to provide space for fasteners 20 to extend through and hold the adjacent L-shaped support members together. The apertures may be sized to provide for adjustability to accommodate for the manufacturing variances in the widths of the beds. For example, the apertures are about 1 inch in length to accommodate adjustments in the overall length of the bed supports.

Figure 3A:
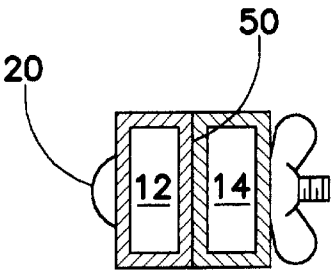
FIG. 3A is a cross-sectional view of the bed support mechanism shown in FIG. 3, taken along lines 3A—3A.
Figure 3:
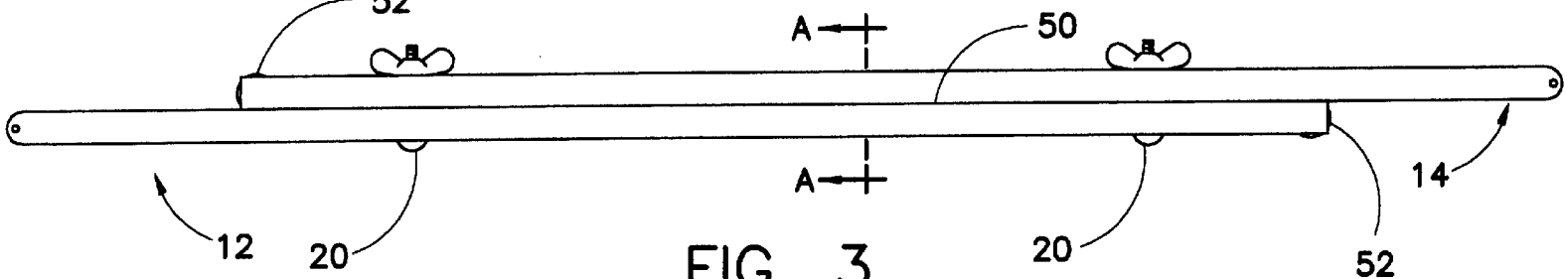
FIG. 3 is a top view of the bed support mechanism shown in FIG. 1.

The fasteners 20 are preferably a bolt and nut arrangement which provides for hand tightening by a user for easy installation and adjustment as illustrated in FIG. 3A. The L-shaped support members may further be attached by other commonly known means such as tape, glue or other type of mechanical fasteners. Preferably, the means of fastening the L-shaped members together provide for repeated fastening and unfastening to allow for adjustability and use for a variety of bed widths.

The side edges 50 of the L-shaped support members provide for mating alignment when placed side-by-side. In a preferred embodiment, as illustrated in FIG. 3A, the side edges 50 are substantially flat which provides for direct abutment with the adjacent L-shaped support member. The side edges 50 may further include complimentary faces such as grooves or ridges that mate with the adjacent L-shaped support member.

A floor guide 52 is attached to the bottom of the leg section 40, as illustrated in FIG. 1. The floor guide is adjustably mounted to the bottom of the leg section to provide for adjustments depending upon the height of the bed. In one preferred embodiment, the leg section 40 and floor guide 52 extend a distance between about eight and thirteen inches from the upper edge of the top section 36. The floor guide 52 provides for easy adjustment by the user such as a screw type arrangement in which the floor guide can be rotated to extend or retract to the desired position.

A spacer 54 may be positioned between the leg section 40 and floor guide 52 to provide for additional vertical spacing as illustrated in FIG. 2. In one preferred embodiment, the combination of the leg section 40, spacer 54, and floor guide 52 provide for vertical positioning between about thirteen and eighteen inches from the upper edge of the top section. The spacer 54 is particularly useful in antique beds which are normally set vertically higher from the floor than more contemporary designs.

Figures 4A, 4B, 4C, 4D, 4E:
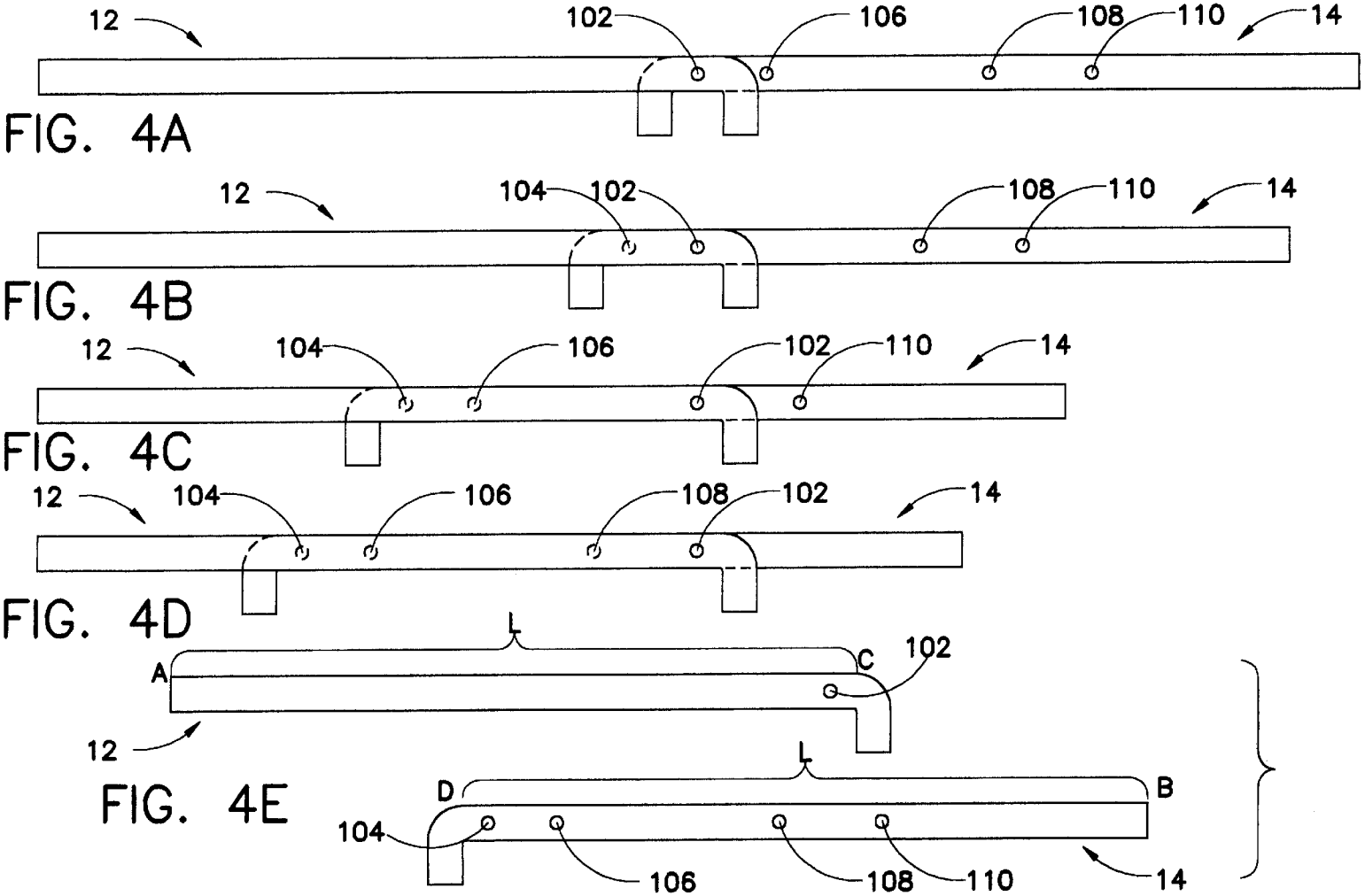
FIGS. 4A–4E illustrate side views of a first embodiment of the aperture placements along the lengths of the support members.

FIGS. 4A–4E illustrate a first aperture arrangement to provide for accommodating each of the four basic bed widths: fifty-four, sixty, seventy-two and seventy-eight. As illustrated in FIG. 4E, the first L-shaped support member 12 has a single aperture 102 and the second L-shaped support member 14 has four apertures 104, 106, 108 and 110. In each of the embodiments, the length of the top section 36 must be greater than ½ of the maximum accommodating bed width. In this embodiment, the length must be greater than about thirty-nine inches to provide for the maximum bed width of the seventy-eight inches. The length of the support arm is defined as the distance from the end of the L-shaped support member, illustrated as Point A in FIG. 4E, to the point at which the top section bends to form the leg section, illustrated as Point C. In each embodiment, the length of the top sections must not be greater than the shortest accommodating bed width. In this embodiment illustrated in FIGS. 4A–4E, about fifty-four inches.

In one embodiment illustrated in FIGS. 4A–4E, the L-shaped support members are substantially identical except for the placement of the apertures. FIG. 4A illustrates the alignment of the L-shaped support members to accommodate a bed width in the range of about seventy-six to about seventy-eight inches. The first support member 12 and first aperture 102 align with the second support member 14 and aperture 104. A single fastening mechanism is attached through the aligned apertures 102, 104 to adjoin the L-shaped support members. FIG. 4B illustrates the arrangement for about a seventy-two inch bed width in which aperture 102 aligns with aperture 106. FIG. 4C illustrates about a sixty inch bed width in which aperture 102 aligns with aperture 108. FIG. 4D illustrates about a fifty-four inch bed width in which aperture 102 aligns with aperture 110.

In this embodiment, aperture 102 is centered about thirty-eight and ½ inches away from Point A, as illustrated in FIG. 4E. Aperture 104 is centered about thirty-eight and ½ inches away from Point B, aperture 106 is centered about thirty-four and ½ inches away from Point B, aperture 108 is centered about twenty-one and ½ inches away from Point B, and aperture 110 is centered about fifteen and ½ inches away from Point B. In one preferred embodiment, the length L of the top section of each of the L-shaped support members 12, 14 is about forty inches.

Figures 5A, 5B, 5C, 5D, 5E:
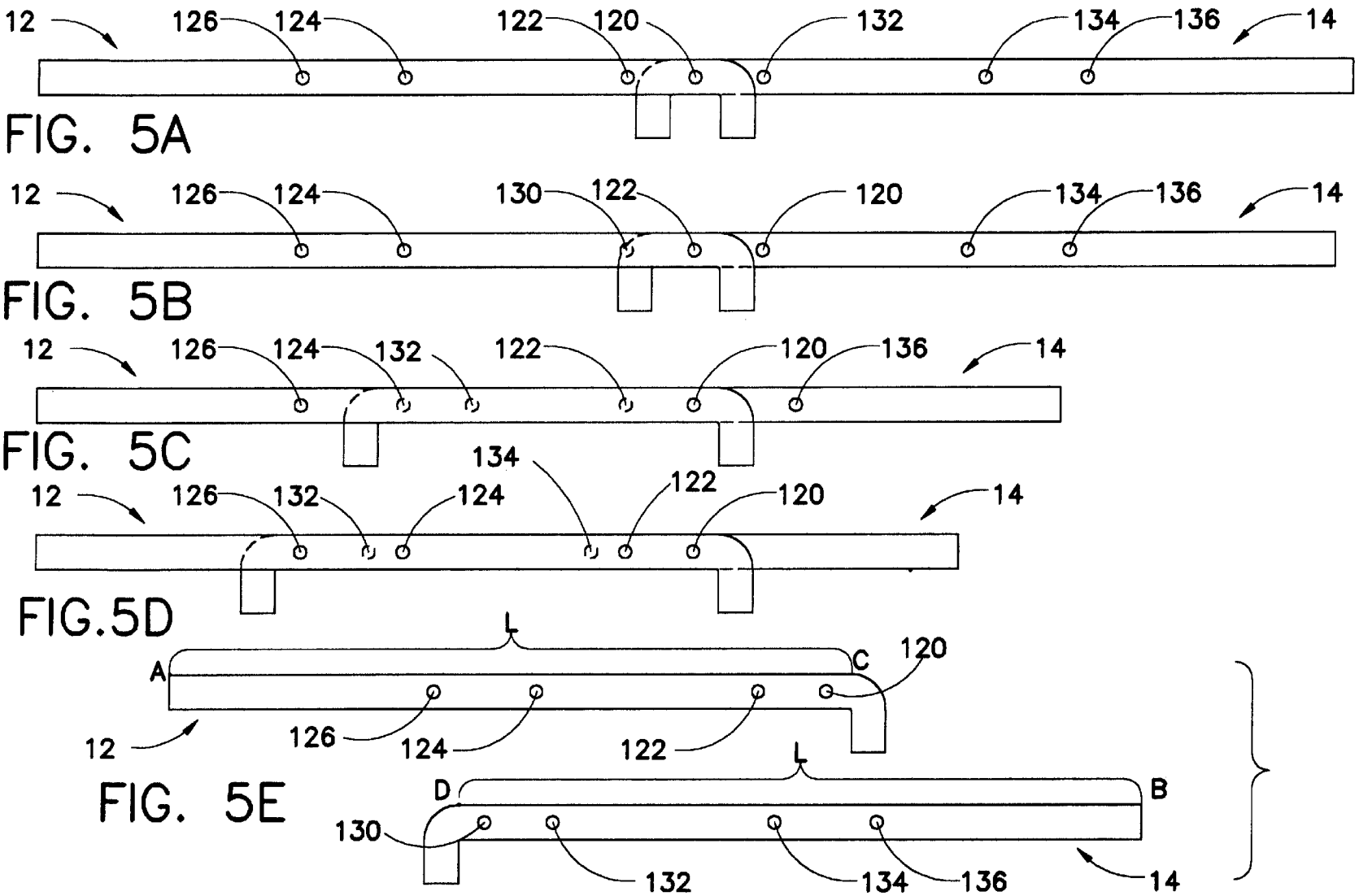
FIGS. 5A–5E illustrate side views of a second embodiment of the aperture placements along the lengths of the support members.

FIGS. 5A–5E illustrate a second embodiment in which each of the L-shaped support members 12, 14 include four apertures spaced along the length. FIG. 5E illustrates the spacing of the apertures: apertures 126, 136 are centered about fifteen and ½ inches from the end of the top sections, Points A and E respectively; apertures 124, 134 are centered about twenty-one and ½ inches from the end of the top sections; apertures 122, 132 are centered about thirty-four and ½ inches from the end of the top sections; and apertures 120, 130 are centered about thirty-eight and ½ inches from the end of the top sections. It will also be understood that the apertures may be elongated to allow for adjustments in the width. By way of example, the embodiment illustrated in FIG. 5A may be between about seventy-six and seventy-eight inches.

FIG. 5A illustrates the alignment to accommodate about a seventy-six to about a seventy-eight inch bed width in which aperture 120 aligns with aperture 130. FIG. 5B illustrates the alignment to accommodate about a seventy-two inch bed width in which aperture 122 aligns with aperture 132. FIG. 5C illustrates the arrangement to accommodate about a sixty inch bed width in which aperture 124 aligns with aperture 130 and aperture 120 aligns with aperture 134. FIG. 5D illustrates the alignment for about a fifty-four inch bed width in which aperture 126 aligns with aperture 130 and aperture 120 aligns with aperture 136. The advantage of this embodiment is that two fasteners may be used to attach the L-shaped support members for a sixty inch and fifty-four inch bed width. Additionally, each of the L-shaped support members 12, 14 are substantially identical including the placement of the apertures.

Figures 6A, 6B, 6C, 6D, 6E:
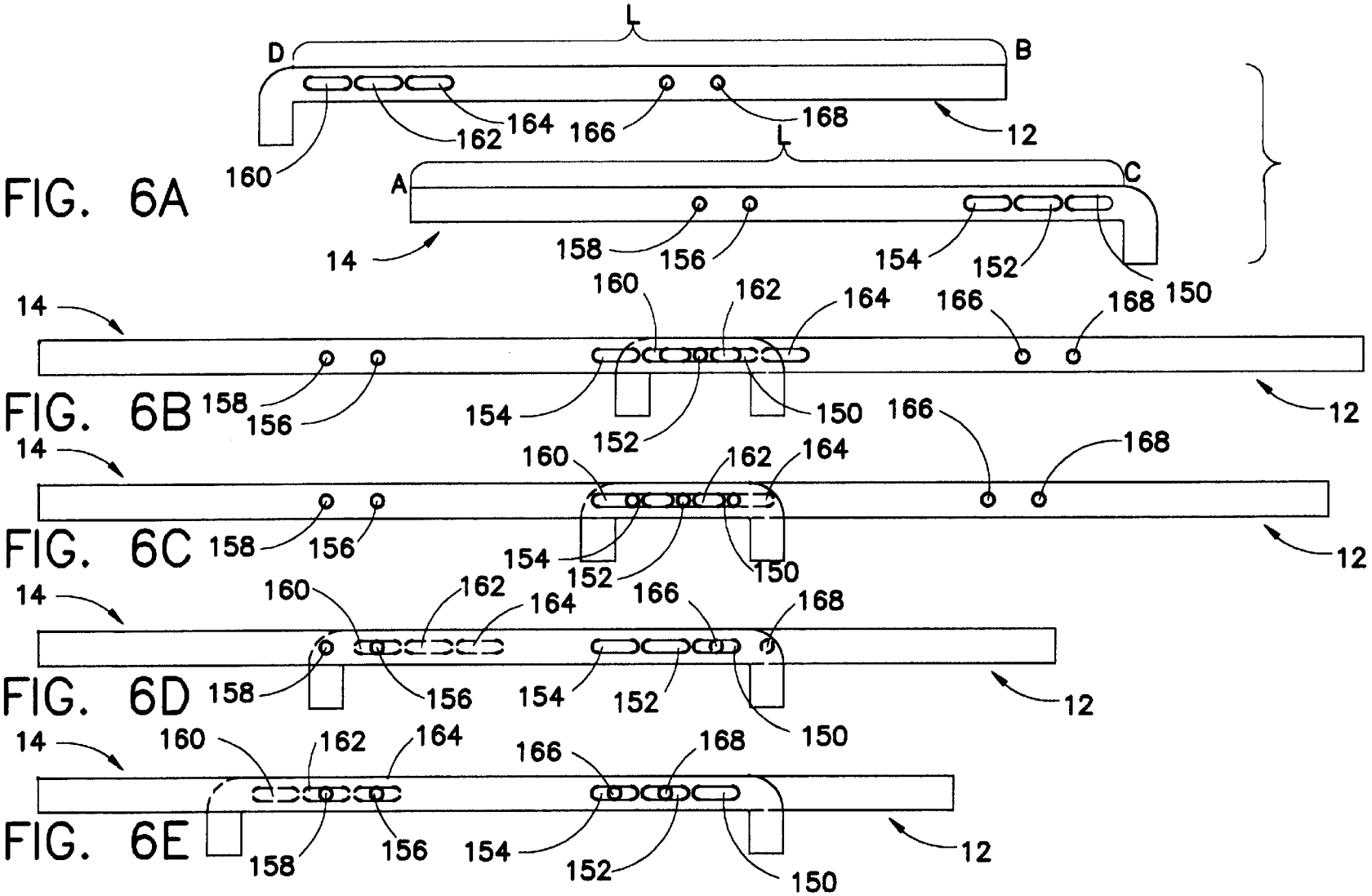
FIGS. 6A–6E are a third embodiment of aperture placements along the length of the support members.
Figure 7:
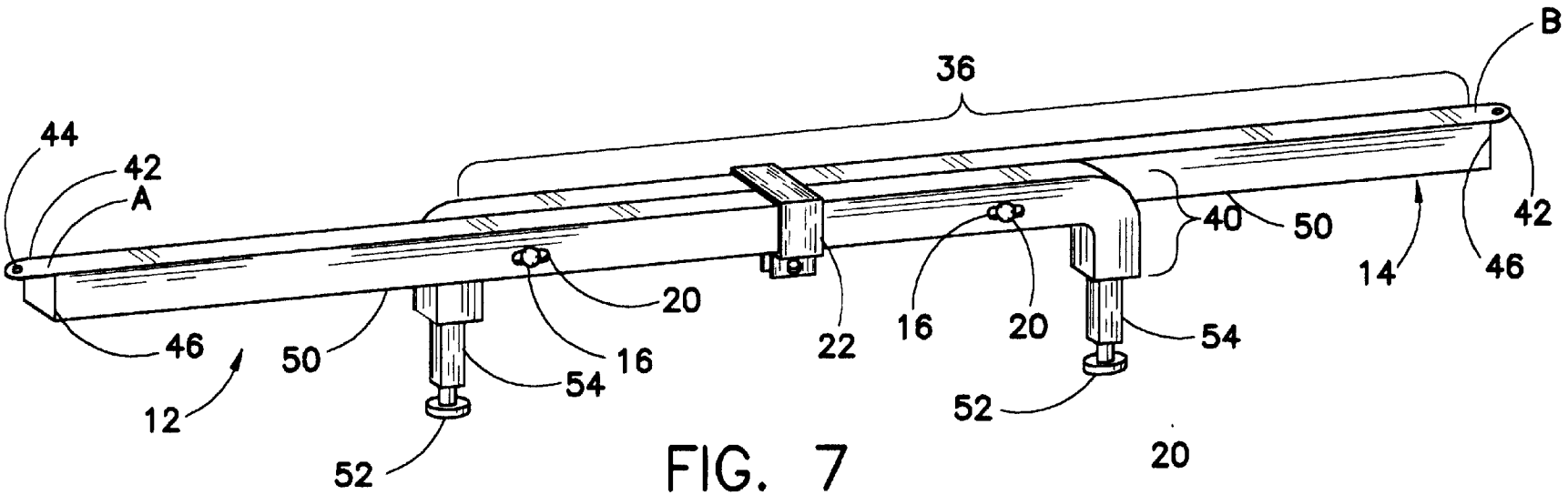

FIGS. 6A–6E illustrate a third separate embodiment in which each of the L-shaped support members 12, 14 include three slots and two apertures. A slot, as illustrated at 160, is equivalent to about a two inch elongated opening. By way of example, slot 160 is centered at about forty inches from point B, and extends between about thirty-nine and forty-one inches. In one preferred embodiment, the length L of the top sections is about forty-two inches. As the slots are elongated, they may extend into the leg sections. However, as illustrated in FIG. 6A, the leg section is sized to allow for the slot extension and still contain a fastener.

The slots and apertures of each of the L-shaped support members 12, 14 are substantially identical: the length of the top section is about forty-two inches; slots 160 and 150 are centered about forty inches from the end of the top sections and extend between about thirty-nine and forty-one inches; slots 162 and 152 are centered about thirty-seven inches from the end of the top sections and extend between about thirty-six and thirty-eight inches; slots 164 and 154 are centered about thirty-four inches from the end of the top sections and extend between about thirty-three and thirty-five inches. Apertures 166 and 156 are centered about twenty inches from the end of the top sections; and apertures 168 and 158 are centered about seventeen inches from the end of the top sections.

FIG. 6B illustrates the alignment to accommodate between about a seventy-six and seventy-eight inch bed width in which slots 160 and 152, and 162 and 150 overlap to allow for fasteners to extend through each of the two openings. FIG. 6C illustrates the alignment for about a seventy-two inch bed width in which slots 162 and 154, and 164 and 152 overlap to provide for fasteners. FIG. 6D illustrates the alignment for about a sixty inch bed width in which slot 160 overlaps with aperture 156 and aperture 166 overlaps with slot 150.

FIG. 6E illustrates about a fifty-four inch bed width in which slot 162 overlaps with aperture 158, slot 164 overlaps with aperture 156, aperture 166 overlaps with slot 154, and aperture 168 overlaps with slot 152. The embodiment illustrated in FIGS. 6A–6E has the advantage of providing two fasteners for about the seventy-six to seventy-eight inch bed width, two fasteners for about the seventy-two inch bed width, two fasteners for about the sixty inch bed width, and four fasteners for about the fifty-four inch bed width.

In viewing the embodiments illustrated in FIGS. 4A–4E, 5A–5E, and 6A–6E, it is apparent that the leg sections 40 of each of the L-shaped support members are maintained at appropriate positions to support the various bed widths. The leg sections are maintained in effective positions for the various bed widths to provide support to the interior of the mattress and box springs. For king sizes that of ten utilize two single box springs, the legs are positioned in the interior of the bed to support the box springs.

Certain modifications and improvements will occur to those skilled in the art upon a reading of the foregoing description. By way of example, one or more C-clamps or U-shaped brackets 2 may be used to attach together the L-shaped support members. The U-shaped bracket may contain an aperture extending through the opposed side walls of the bracket for receiving a bolt which extends through the L-shaped members or may fit around to "snap-on" and lock together the L-shaped members. It should be understood that all such modifications and improvements have been deleted herein for the sake of conciseness and readability but are properly within the scope of the following claims.

I claim:

1. A bed frame having a supplemental bed support mechanism, said mechanism comprising at least two substantially identical L-shaped support members each including a top section and a leg section, said top sections being adjacently positioned to one another and each of said leg sections extending downward at opposite ends of said adjacently positioned L-shaped support members wherein the distal end of each of said L-shaped support members are connected to the bed frame at the ends opposite said leg sections, said leg sections overlapping to provide support for a bed.

2. The apparatus of claim 1, further including means for selectively positioning said L-shaped support members to provide support for a bed having a width in the range of between about 54 inches to about 78 inches.

3. The apparatus of claim 2, wherein the length of the top section of each of said L-shaped support members is greater than about one-half of about 78 inches.

4. The apparatus of claim 2, wherein the length of the top section of each of said L-shaped support members is less than the width of about 54 inches.

5. The apparatus of claim 1, wherein said L-shaped support members are connected together by at least one clamp.

6. The apparatus of claim 1, wherein each of said L-shaped support members further includes at least one aperture spaced along the length of said top section wherein said apertures align at preselected positions along the length of said L-shaped support members for inserting a fastener.

7. The apparatus of claim 6, wherein the position of said apertures is the same for each of said L-shaped support members.

8. The apparatus of claim 6, wherein said apertures are elongated for accommodating manufacturing variances in the bed widths.

9. The apparatus of claim 1, wherein a first L-shaped support member has one aperture and a second L-shaped support member fastened with said first L-shaped support member has four apertures.

10. The apparatus of claim 9, wherein the first L-shaped support member has an aperture centered about 38.5 inches from a first end of said first member top section and said second L-shaped support member has apertures centered at about 38.5 inches, 34.5 inches, 21.5 inches, and 15.5 inches from a first end of said second member top section.

11. The apparatus of claim 1, wherein said connected first and second L-shaped support members each have four apertures spaced along the length of said top sections.

12. The apparatus of claim 11, wherein said apertures of said first and second L-shaped support members are centered about 38.5 inches, 34.5 inches, 21.5 inches, and 15.5 inches from a first end of each of said support members.

13. The apparatus of claim 1, wherein said connected first and second L-shaped support members each have three slots and two apertures spaced along the length of said top sections.

14. The apparatus of claim 13, wherein said slots are centered about 40 inches, 37 inches, 34 inches from a first end of each of said support members and said apertures are centered about 20 inches and 17 inches from said first end of said support members.

15. The apparatus of claim 1, wherein each of said L-shaped support member further includes a mount positioned at said top section opposite said leg section, said mount for connecting said L-shaped support member to a bed rail.

16. A bed support mechanism for providing supplemental support for a bed, said mechanism comprising:

(a) at least two substantially identical L-shaped support members each including a top section and a log section, said top sections being adjacently positioned to one another and each of said leg sections extending downward at opposite ends of said adjacently positioned L-shaped support members wherein the distal end of each of said L-shaped support members are connected to the bed frame at the ends opposite said leg sections, said leg sections overlapping to provide support for a bed; and (b) an adjustable foot connected to the distal end of each of said leg section and extending to the floor to provide adjustment for beds of different heights.

17. The apparatus of claim 16, wherein each of said leg sections are positioned at an angle of about ninety degrees relative to said top section.

18. The apparatus of claim 16, wherein said foot is adjustably positionable to accommodate beds having a height between about 8 inches and 13 inches.

19. The apparatus of claim 18, further including a fixed spacer between said foot and the distal end of said leg section, wherein said foot is adjustably positionable to accommodate beds having a height between about 13 inches and 18 inches.

20. The apparatus of claim 16, wherein each of said L-shaped support members includes a mating face wherein said mating face of said first L-shaped support member abuts said mating face of said adjacently positioned second L-shaped support member.

21. The apparatus of claim 20, wherein said mating face of each of said L-shaped support members are substantially flat.

22. The apparatus of claim 20, wherein said mating face of each of said L-shaped support members includes ridges that mate together.

23. A bed frame having a supplemental bed support mechanism, said mechanism comprising:

(a) at least two substantially identical L-shaped support members each including a top section and a leg section, said top sections being adjacently positioned to one another and each of said leg sections extending downward at opposite ends of said adjacently positioned L-shaped support members wherein the distal end of each of said L-shaped support members are connected to the bed frame at the ends opposite said leg sections, said leg sections overlapping to provide support for a bed, (b) an adjustable foot connected to the distal end of each of said leg sections to provide adjustment for beds of different heights; and (c) means for selectively positioning said L-shaped support members to provide support for a bed having a width in the range of between about 54 inches to about 78 inches.

24. The apparatus of claim 23, wherein the length of the top section of each of said L-shaped support members is greater than about one-half of about 78 inches.

25. The apparatus of claim 23, wherein the length of the top section of each of said L-shaped support members is less than the width of about 54 inches.

26. The apparatus of claim 23, wherein said L-shaped support members are connected together by at least one clamp.

27. The apparatus of claim 23, wherein each of said L-shaped support members further includes at least one aperture spaced along the length of said top section wherein said apertures align at pre-selected positions along the length of said L-shaped support members for inserting a fastener.

28. The apparatus of claim 27, wherein the position of said apertures is the same for each of said pair of said L-shaped support members.

29. The apparatus of claim 27, wherein said apertures are elongated for accommodating manufacturing variances in the bed widths.

30. The apparatus of claim 23, wherein a first L-shaped support member has one aperture and a second L-shaped support member fastened with said first L-shaped support member has four apertures.

31. The apparatus of claim 30, wherein the first L-shaped support member has an aperture centered about 38.5 inches from a first end of said first member top section and said second L-shaped support member has apertures centered at about 38.5 inches, 34.5 inches, 21.5 inches, and 15.5 inches from a first end of said second member top section.

32. The apparatus of claim 23, wherein said connected first and second L-shaped support members each have four apertures spaced along the length of said top sections.

33. The apparatus of claim 32, wherein said apertures of said first and second L-shaped support members are centered about 38.5 inches, 34.5 inches, 21.5 inches, and 15.5 inches from a first end of each of said support members.

34. The apparatus of claim 23, wherein said connected first and second L-shaped support members each have three slots and two apertures spaced along the length of said top sections.

35. The apparatus of claim 34, wherein said slots are centered about 40 inches, 37 inches, 34 inches from a first end of each of said support members and said apertures are centered about 20 inches and 17 inches from said first end of said support members.

36. The apparatus of claim 23, wherein each of said L-shaped support member further includes a mount positioned at said top section opposite said leg section, said mount for connecting said L-shaped support member to a bed rail.

37. The apparatus of claim 23, wherein each of said leg sections are positioned at an angle of about ninety degrees relative to said top section.

38. The apparatus of claim 23, wherein said foot is adjustably positionable to accommodate beds having a height between about 8 inches and 13 inches.

39. The apparatus of claim 38, further including a fixed spacer between said foot and the distal end of said leg section, wherein said foot is adjustably positionable to accommodate beds having a height between about 13 inches and 18 inches.

40. The apparatus of claim 23, wherein each of said L-shaped support members includes a mating face wherein said mating face of said first L-shaped support member abuts said mating face of said adjacently positioned second L-shaped support member.

41. The apparatus of claim 40, wherein said mating face of each of said L-shaped support members are substantially flat.

42. The apparatus of claim 40, wherein said mating face of each of said L-shaped support members includes ridges that mate together.

* * * * *